US006716802B1

(12) United States Patent
Custer et al.

(10) Patent No.: US 6,716,802 B1
(45) Date of Patent: Apr. 6, 2004

(54) POLISHING SYSTEMS, METHODS OF POLISHING SUBSTRATES, AND METHODS OF PREPARING LIQUIDS FOR SEMICONDUCTOR FABRICATION PROCESSES

(75) Inventors: Dan G. Custer, Caldwell, ID (US); Aaron Trent Ward, Kuna, ID (US); Shawn M. Lewis, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/298,160

(22) Filed: Apr. 22, 1999

Related U.S. Application Data

(62) Division of application No. 08/984,730, filed on Dec. 4, 1997.

(51) Int. Cl.[7] ..... C02F 1/20

(52) U.S. Cl. ..... 510/108; 510/175; 95/241; 95/254; 210/220; 210/900

(58) Field of Search ..... 134/1, 1.2, 2, 3, 134/26, 28, 29, 902; 510/108, 175; 95/241, 254; 210/220, 900

(56) References Cited

U.S. PATENT DOCUMENTS

| | | | | |
|---|---|---|---|---|
| 4,817,652 A | * | 4/1989 | Liu et al. | 134/102 |
| 4,894,342 A | * | 1/1990 | Guinn et al. | 435/297.4 |
| 5,110,741 A | | 5/1992 | Ohi et al. | |
| 5,149,380 A | | 9/1992 | Decker | 134/22.13 |
| 5,340,437 A | * | 8/1994 | Erk et al. | 156/639 |
| 5,670,011 A | | 9/1997 | Togawa et al. | 451/41 |
| 5,702,291 A | | 12/1997 | Isobe | 451/41 |
| 5,733,177 A | | 3/1998 | Tsuchiya et al. | 451/41 |
| 5,766,321 A | | 6/1998 | Ishihara et al. | |
| 5,783,790 A | | 7/1998 | Mitsumori et al. | |
| 5,795,494 A | | 8/1998 | Hayami et al. | 216/83 |

(List continued on next page.)

FOREIGN PATENT DOCUMENTS

WO WO 94/23816 10/1994

OTHER PUBLICATIONS

Hodgman, M.S., Charles D., "Handbook of Chemistry and Physics A Ready–Reference Book of Chemical and Phyical Data," 27 Ed., ©1910, 3 pages.

*Primary Examiner*—Allan Olsen
(74) *Attorney, Agent, or Firm*—Well St. John P.S.

(57) ABSTRACT

The invention encompasses polishing systems for polishing semiconductive material substrates, and encompasses methods of cleaning polishing slurry from semiconductive substrate surfaces. In one aspect, the invention includes a method of cleaning a polishing slurry from a substrate surface comprising: a) providing a substrate surface having a polishing slurry in contact therewith; b) providing a liquid; c) injecting a gas into the liquid to increase a total dissolved gas concentration in the liquid; and d) after the injecting, providing the liquid against the substrate surface to displace the polishing slurry from the substrate surface. In another aspect the invention includes a method of polishing a substrate surface comprising: a) providing a polishing slurry between a substrate surface and a polishing pad; b) polishing the substrate surface with the polishing slurry; and c) removing the polishing slurry from the substrate surface, the removing comprising: i) providing a liquid; ii) removing a first gas from the liquid to reduce a total dissolved gas concentration in the liquid; iii) after the removing, dissolving a second gas in the liquid to increase the total dissolved gas concentration in the liquid; iv) after the dissolving, providing the liquid between the substrate surface and the polishing pad to displace the polishing slurry from the substrate surface.

13 Claims, 2 Drawing Sheets

U.S. PATENT DOCUMENTS 5,797,789 A 8/1998 Tanaka et al. ..... 451/41
5,800,626 A * 9/1998 Cohen et al. ..... 134/1.3
5,849,091 A * 12/1998 Skrovan et al. ..... 134/1
5,858,106 A * 1/1999 Ohmi et al. ..... 134/1
5,885,134 A 3/1999 Shibata et al. ..... 451/41
5,887,605 A 3/1999 Lee et al.
5,906,532 A 5/1999 Nakajima et al. ..... 451/41
5,931,722 A * 8/1999 Ohmi et al. ..... 451/271
6,039,815 A * 3/2000 Yeol et al. ..... 134/2
6,082,373 A 7/2000 Sakurai et al. ..... 134/1
6,416,676 B1 7/2002 Hill

* cited by examiner

POLISHING SYSTEMS, METHODS OF POLISHING SUBSTRATES, AND METHODS OF PREPARING LIQUIDS FOR SEMICONDUCTOR FABRICATION PROCESSES

RELATED PATENT DATA

This patent resulted from a divisional application of U.S. patent application Ser. No. 08/984,730, which was filed on Dec. 4, 1997.

TECHNICAL FIELD

The invention pertains to methods and apparatuses for increasing dissolved gas concentrations in liquids and to methods of providing liquids for semiconductive wafer fabrication processes, such as polishing systems. The invention also pertains to methods of cleaning polishing slurry from semiconductive substrate surfaces.

BACKGROUND OF THE INVENTION

In many semiconductive material fabrication processes it is desirable to utilize deionized and degassed water. The deionization is used to remove elemental contaminants from the water and can increase a resistance of the water to from about 200 kohms to about 1800 kohms.

The degassification is used to remove carbon dioxide from the water. Carbon dioxide can influence a pH of the water. The degassification also, however, removes other gasses from water besides carbon dioxide. Such other gasses can include, for example, oxygen and nitrogen. An example unit for degassifying water is a Liquicell unit (available from Hoechst Celanese Corp. at 13800 South Lake Drive, Charlotte, N.C. 28273), which removes gasses via a gas permeable membrane.

The deionization and degassification of water is typically done on a system-wide scale in a semiconductive material fabrication plant. Accordingly, all water supplied to the various fabrication units of the plant is degassed and deionized.

SUMMARY OF THE INVENTION

The invention encompasses methods and apparatuses for increasing dissolved gas concentrations in liquids, and methods of providing liquids for semiconductive wafer fabrication processes, such as polishing systems. The invention also encompasses polishing systems for polishing semiconductive material substrates, and methods of cleaning polishing slurry from semiconductive substrate surfaces.

In one aspect, the invention encompasses a method of preparing a liquid for a semiconductor fabrication process. A liquid is provided, and a gas is injected into the liquid to increase a total dissolved gas concentration in the liquid.

In another aspect, the invention encompasses a method of cleaning a polishing slurry from a substrate surface. A substrate surface is provided, and a polishing slurry is provided in contact with the substrate surface. A liquid is provided. A gas is injected into the liquid to increase a total dissolved gas concentration in the liquid. After the injecting, the liquid is provided against the substrate surface to displace the polishing slurry from the substrate surface.

In yet another aspect, the invention encompasses a method of polishing a substrate surface. A polishing slurry is provided between a substrate surface and a polishing pad. The substrate surface is polished with the polishing slurry. The polishing slurry is removed from the substrate surface. The removing comprises the following. A liquid is provided. A first gas is removed from the liquid to reduce a total dissolved gas concentration in the liquid. After removing the first gas, a second gas is dissolved in the liquid to increase the total dissolved gas concentration in the liquid. After dissolving the second gas, the liquid is provided between the substrate surface and the polishing pad to displace the polishing slurry from the substrate surface.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with the present invention it is recognized that liquids utilized for various wafer fabrication processes will preferably have at least a threshold dissolved gas concentration. It has been discovered that if water utilized in polishing processes has a dissolved gas concentration below a threshold, wafers will slip out of a polishing apparatus at a significantly higher frequency than if the dissolved gas concentration is above the threshold. It is also expected that if water utilized in a semiconductor wafer etch or polish processes has a dissolved gas concentration below a threshold, the water will become a better solvent for various etchant or polishing compounds than if the dissolved gas concentration is above the threshold. The better solvent properties of the water can alter an etch or polish rate and lead to defects in the etched or polished wafer. Such defects can include domed regions, inclusions, and cavities. Accordingly, the present invention encompasses methods of providing dissolved gasses in water and other liquids.

Figure 1:
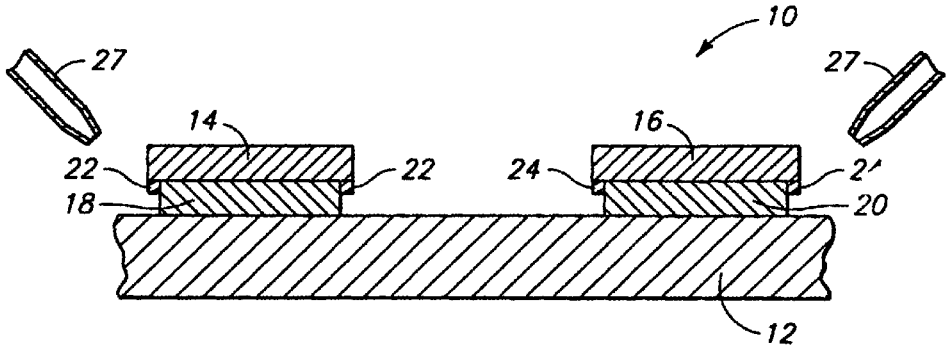
FIG. 1 is a fragmentary, diagrammatic cross-sectional view of a polishing apparatus for polishing a semiconductive wafer.

An example polishing process is described with reference to a polishing apparatus 10 in FIGS. 1 and 2. Polishing apparatus 10 can, for example, be an apparatus configured to accomplish chemical-mechanical polishing. Apparatus 10 comprises a polishing pad 12 and semiconductive wafer holders 14 and 16.

Wafer holders 14 and 16 hold a pair of semiconductive wafers 18 and 20 adjacent a surface of the polishing pad 12. Wafer holders 14 and 16 comprise sidewalls 22 and 24, respectively. Generally, semiconductive wafers 18 and 20 are circular in shape, and sidewalls 22 and 24 are circular and ring-shaped to completely encircle wafers 18 and 20.

In operation, a polishing slurry is provided between semiconductive wafers 18 and 20, and polishing pad 12. The polishing slurry can comprise, for example, ILD 1300 or MSW 1300 manufactured by Rodel, Inc. of Delaware. After the slurry is provided, wafer holders 14 and 16 are utilized to move wafers 18 and 20 relative to polishing pad 12 to polish surfaces of wafers 18 and 20 with the slurry.

Figure 2:
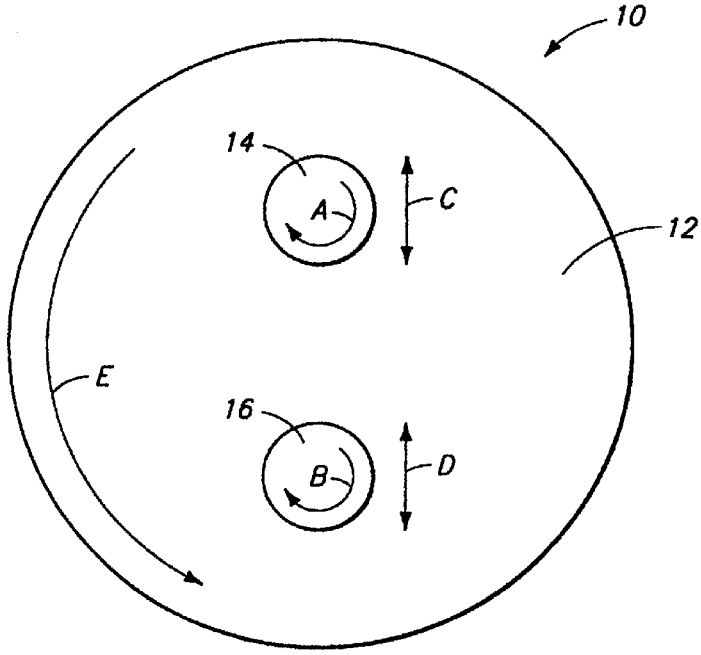
FIG. 2 is a top view of the FIG. 1 apparatus.

As shown in FIG. 2, wafer holders 16 and 18 are preferably configured to move semiconductive wafers 18 and 20 in a number of directions relative to polishing pad 12 during a polishing process. Such directions are illustrated by axes "A," "B," "C," "D," and "E." Axes A, B, and E are rotational axes, and axes C and D are translational axes. The many varied rotations and translations illustrated in FIG. 2 enable wafers 18 and 20 to be polished quickly and uniformly.

Polishing apparatus 10 comprises a pair of nozzles 27. After a surface of wafers 18 and 20 is polished, a liquid is introduced through nozzles 27 and onto polishing pad 12 to displace the polishing slurry from between wafers 18 and 20 and polishing pad 12. Wafers 18 and 20 typically are moved relative to polishing pad 12 as the liquid is provided onto polishing pad 12. The liquid preferably comprises deionized water, and more preferably consists essentially of deionized water having some dissolved gas therein. In accordance with the present invention, it has been discovered that if the liquid comprises too low of a dissolved gas concentration, excess friction will develop between wafers 18 and 20 and polishing pad 12. Such excess friction can result in wafers 18 and 20 being disastrously expelled from wafer holders 14 and 16, a so-called "slip-out" of the wafers.

A method for determining total dissolved gas in water is to measure the concentration of dissolved oxygen. As discussed in the Background section of this disclosure, degassification procedures are generally not selective for particular dissolved gasses and lower all dissolved gasses in a liquid. A dissolved oxygen concentration can be particularly conveniently measured by methods known to persons of ordinary skill in the art. It is therefore expedient to quantitate a dissolved oxygen concentration and to use this as an indicator of a total dissolved gas concentration in a source of water. It has been found experimentally that if the dissolved oxygen concentration in a source of water is above about 150 parts per billion (ppb), preferably above about 190 ppb, and more preferably above about 200 ppb, slip-out of wafers can be avoided. However, when the dissolved oxygen concentration falls to below 150 ppb slip-out becomes unacceptably frequent. Often, slip-out becomes unacceptably frequent if the dissolved oxygen concentration falls to below 200 ppb. Currently utilized degassification procedures will reduce dissolved oxygen concentrations to about 4 ppb, which is too low for many polishing processes. Accordingly, it is desirable to regassify water prior to utilization in polishing processes.

The gas provided in a liquid during a regassification procedure can have a composition different from the gas removed from the liquid during a degassification procedure. The gas removed from the liquid during the degassification process is a first gas which will generally have a composition similar to that of the atmosphere. The gas provided back into the liquid during a regassification is a second gas which is preferably a relatively cheap and non-reactive gas, such as argon or nitrogen. The second gas is preferably provided to a concentration of at least 200 ppb, preferably of from about 450 ppb to about 550 ppb, and more preferably of at least about 500 ppb. Such concentration of second gas has been found experimentally to convert a degassified liquid having 4 ppb of dissolved oxygen to a liquid which will significantly reduce slip-out of wafers. An exemplary upper limit of the second gas which can be added to deionized water is about 7 parts per million (ppm), as this is about the maximum amount of dissolved gas that deionized water can retain at room temperature and atmospheric pressure.

A preferred method for regassifying a liquid is described with reference to a regassification apparatus 50 in FIG. 3. Apparatus 50 comprises a pipe 52 through which a liquid flows from a source 54 to a polishing apparatus 56. Pipe 52 can comprise, for example, a nominal half-inch inner diameter. Pipe 52 comprises a tee 58 wherein a gas is injected with the liquid to increase a dissolved gas concentration in the liquid. The gas flows from a source 60, through a pressure regulator 62, a flowmeter 64, a pressure/flow switch 66, a check valve 68, and a gas dispersion unit 70 to inject with liquid in tee 58. Source 60 preferably comprises the gas stored at pressure greater than atmospheric pressure.

Gas dispersion unit 70 can comprise, for example, a sintered filter. A sintered filter 70 can comprise a number of materials and constructions known to persons of skill in the art. For example, filter 70 can comprise a stainless steel filter having about 0.5 micron pores. Filter 70 comprises a nipple 72 extending beneath tee 58 and having, for example, about a one-quarter inch diameter.

In an example process wherein nitrogen is flowed into water, a pressure of the nitrogen will preferably be maintained at about 100 pounds per square inch gauge (psig), and a flow of the nitrogen will preferably be maintained at about 750 cubic centimeters per minute (ccpm). Also, check valve 68 will preferably be set to a pressure of 2 psi. The water will preferably be flowed through pipe 52 at a rate of from about 2.5 gallons per minute to about 4 gallons per minute, and a pressure of 45–50 psig.

Pipe 52 defines a tube through which fluid flows. The liquid from source 54 and gas from source 60 meet within such tube. By having the liquid confined in a tube as it is injected with gas, a controlled pressure of liquid and gas can be maintained to substantially ensure that the gas dissolves within the liquid.

Figure 3:
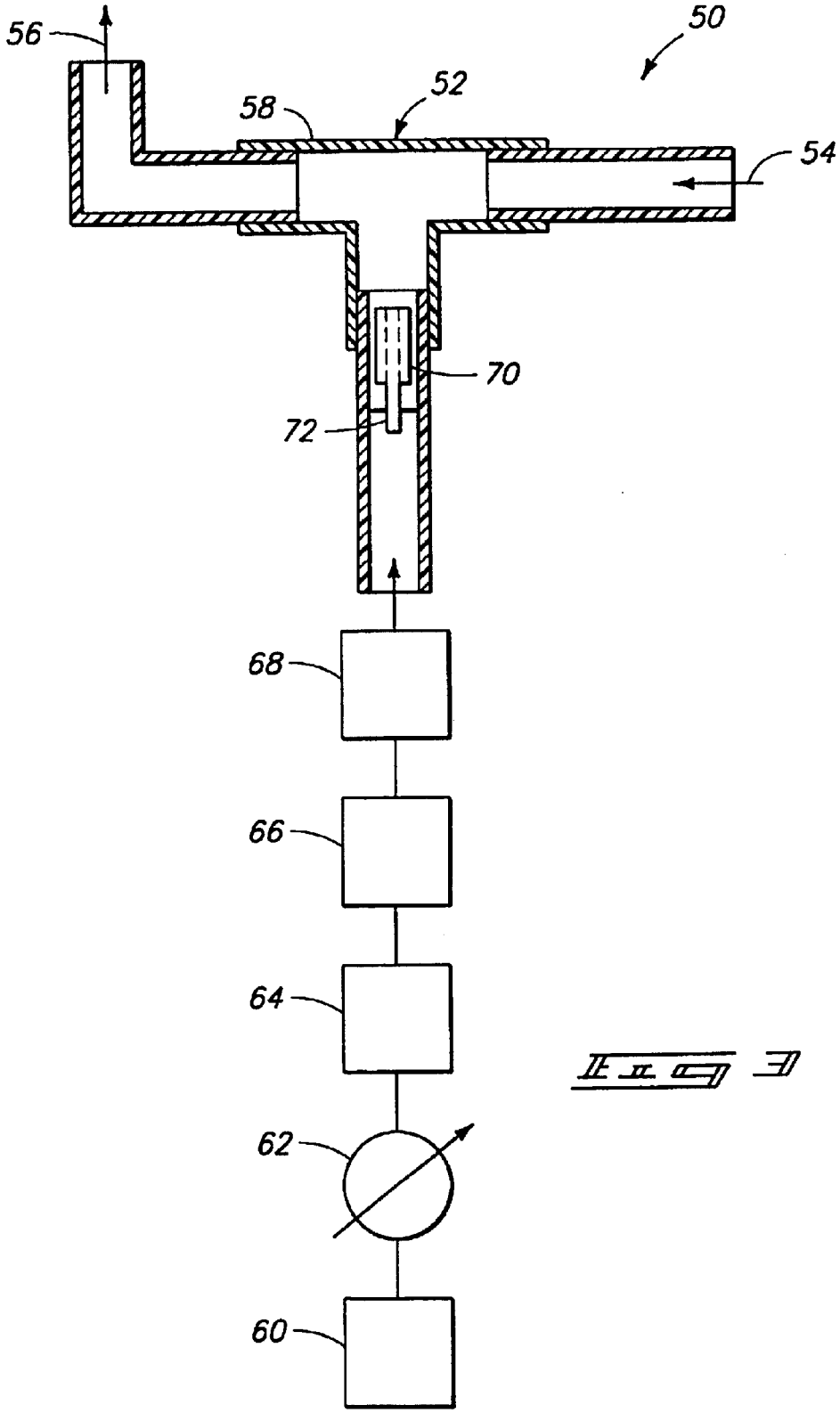
FIG. 3 is a diagrammatic and schematic cross-sectional view of a gassification apparatus of the present invention.

The apparatus of FIG. 3 represents a preferred method for increasing a total dissolved gas concentration in a liquid. Another method for increasing a total dissolved gas concentration in a liquid is to introduce a flush gas in a gas-permeable-membrane-based degassification procedure. An example gas-permeable-membrane-based degassification procedure is a Liquicell procedure. The flush gas is provided at the membrane during degassification and helps to remove inherent gasses from a liquid as the liquid is degassified. Some of the flush gas will remain in the liquid after the liquid passes through the degassification apparatus. For instance, if nitrogen is utilized as a flush gas in a degassification membrane procedure, the nitrogen will essentially replace at least some of the carbon dioxide and other gasses originally present in the liquid. Thus, the water is both degassed and regassified in a common step.

Persons of ordinary skill in the art will recognize that a dissolved nitrogen concentration in the "degassed" water can be adjusted by adjusting a flow of the nitrogen flush gas. If the water is to be utilized in a polishing process of the present invention, the nitrogen gas flow rate will preferably be adjusted to result in nitrogen being present in the water at concentrations in excess of 200 ppb, and more preferably at concentrations in a range of from 450 ppb to about 550 ppb.

The methods discussed above for regassifying liquids have been described for applications in which the regassified liquids are utilized to displace slurries from polishing apparatuses. It is to be understood that such regassified liquids can also be utilized for other semiconductive wafer fabrication processes. For instance, the regassified liquids could be utilized for cleaning semiconductive wafers prior to processing steps. For example, semiconductive wafers are frequently washed with deionized water prior to polishing of the wafers in a polishing apparatus. Such deionized water can be regassified water produced in accordance with methods of the present invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of preparing a polishing process liquid for a semiconductor polishing process comprising:

providing a liquid;

degassifying the liquid;

injecting a gas into the liquid to regassify the liquid, the regassification increasing a total dissolved gas concentration in the liquid to greater than or equal to 200 ppb, the regassification forming the polishing process liquid; and wherein the injecting the gas into the degassified liquid increases the total dissolved gas concentration in the liquid to from about 450 ppb to about 550 ppb.

2. The method of claim 1 wherein the liquid comprises water.

3. The method of claim 1 wherein the semiconductor polishing process comprises an etch process.

4. The method of claim 1 wherein the semiconductor polishing process comprises a wet etch process and the liquid comprises water.

5. The method of claim 1, where degassifying the liquid comprises removing a first gas from the liquid and the gasifying the liquid comprises adding a second gas, the first gas and the second gas having different compositions.

6. The method of claim 5, where the first gas composition comprises a composition similar to that of the atmosphere and the second gas composition is an essentially non-reactive gas composition.

7. The method of claim 5, where the second gas composition comprises nitrogen and/or argon.

8. The method of claim 1, where the injected gas does not include oxygen.

9. The method of claim 1, where injecting the gas into the degassified liquid increases the total dissolved gas concentration in the liquid to at least about 500 ppb.

10. The method of claim 1, where the providing supplies a liquid having a total dissolved concentration of oxygen that is greater than or equal to 200 ppb.

11. The method of claim 10, where the liquid provided comprises water.

12. The method of claim 1, where injecting the gas into the degassified liquid comprises injecting the gas through a sintered filter.

13. The method of claim 1, where the degassification and the regassification comprise a common processing step.

* * * * *